United States Patent [19]

Koble, Jr.

[11] 4,439,375

[45] Mar. 27, 1984

[54] EVAPORATIVE COOLER APPARATUS

[75] Inventor: Robert L. Koble, Jr., Phoenix, Ariz.

[73] Assignee: Phoenix Manufacturing, Inc., Phoenix, Ariz.

[21] Appl. No.: 395,099

[22] Filed: Jul. 6, 1982

[51] Int. Cl.[3] ..... B01F 3/04

[52] U.S. Cl. ..... 261/29; 261/106

[58] Field of Search ..... 261/29, 24, 106, DIG. 15

[56] References Cited

U.S. PATENT DOCUMENTS

| | | | |
|---|---|---|---|
| 1,916,907 | 7/1933 | Sargent | 261/24 |
| 2,233,976 | 3/1941 | Essick | 261/29 |
| 2,934,022 | 4/1960 | Rodick et al. | 261/29 |
| 3,171,401 | 3/1965 | McDuffee | 261/DIG. 15 |
| 3,290,020 | 12/1966 | Findley | 261/29 |
| 3,437,318 | 4/1969 | Abbott et al. | 261/DIG. 15 |
| 4,029,723 | 6/1977 | Morrison et al. | 261/DIG. 15 |

*Primary Examiner*—Tim R. Miles

*Attorney, Agent, or Firm*—H. Gordon Shields

[57] ABSTRACT

Evaporative cooler apparatus includes a relatively thin housing adapted to be secured to a window and a module at the front of the housing adapted to be secured to the housing in any of four orientations so as to fit with the type of window for which the apparatus is to be used.

6 Claims, 8 Drawing Figures

FIG. 1
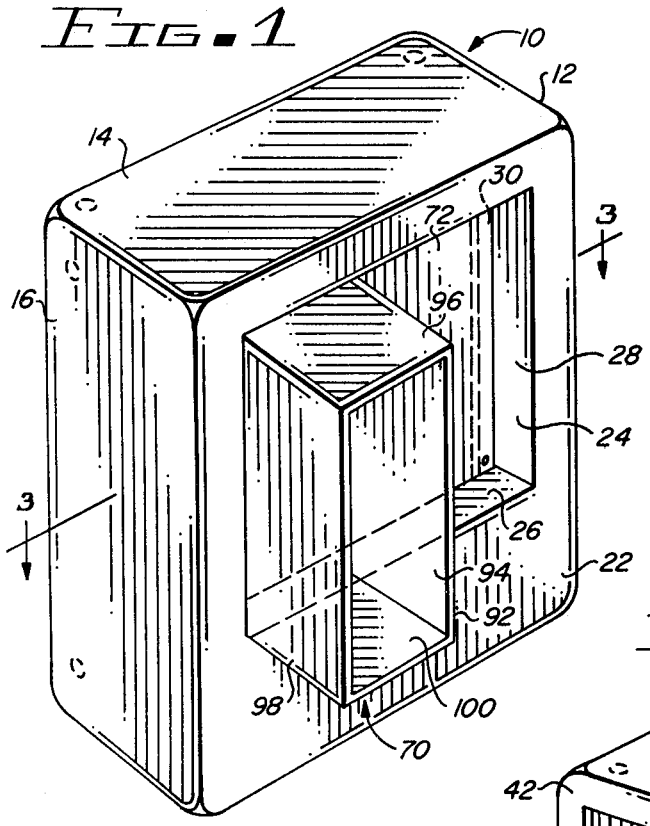
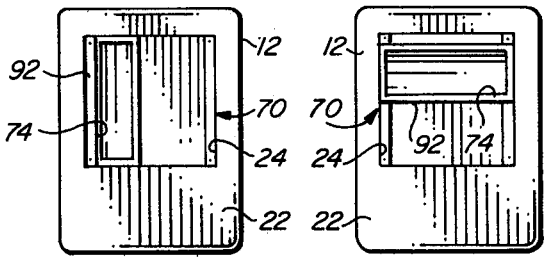
FIG. 4A FIG. 4B
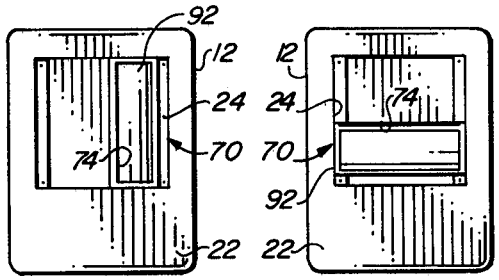
FIG. 4C FIG. 4D
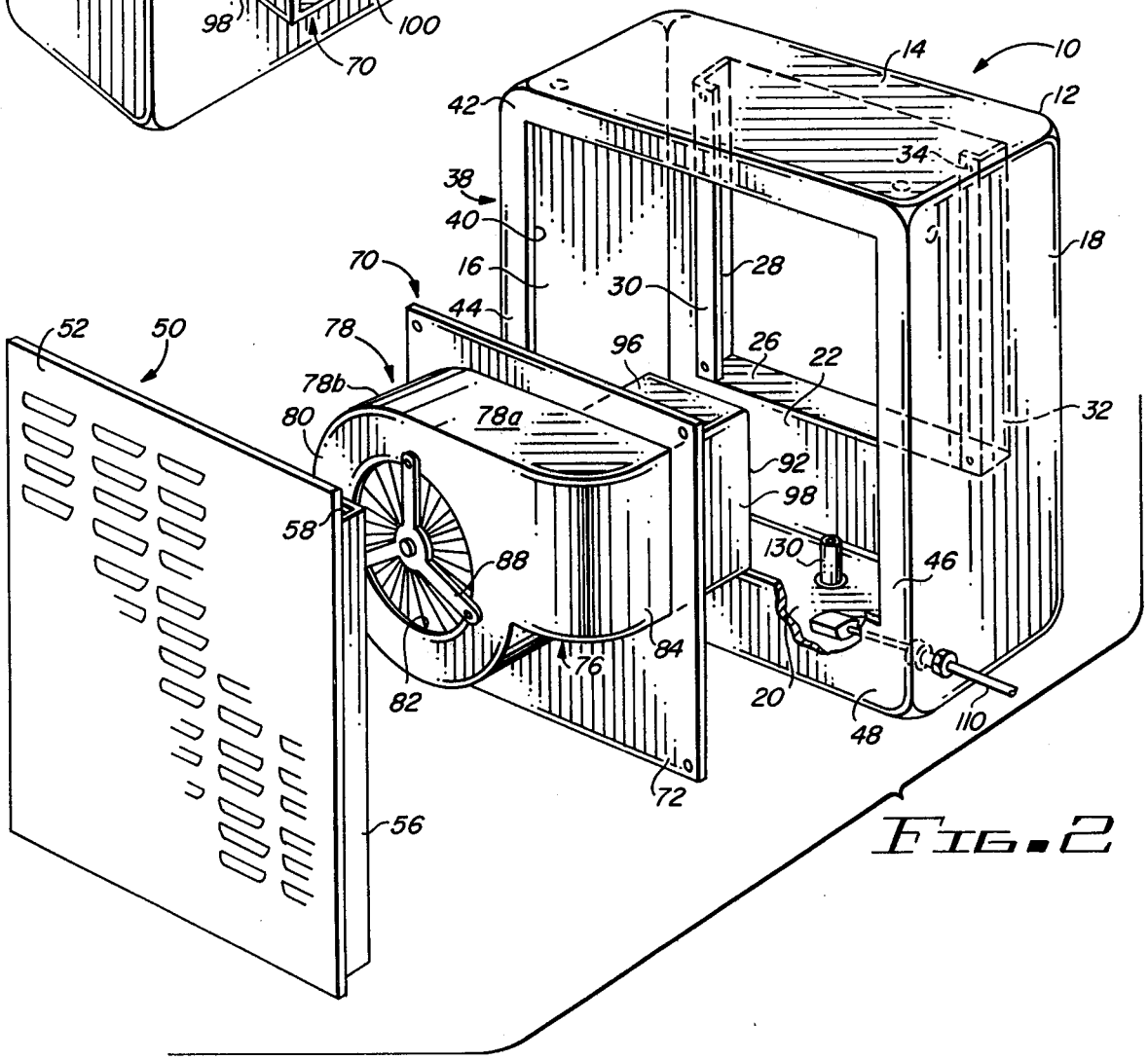
FIG. 2

EVAPORATIVE COOLER APPARATUS

BACKGROUND OF THE INVENTION

1. Field of the Invention:

This invention relates to evaporative coolers and, more particularly, to evaporative coolers designed for use with windows.

2. Description of the Prior Art:

Evaporative coolers of the prior art are generally of two primary types. The first type is relatively large, generally at rectangular (cube) configuration adapted to be disposed on the top of a house or other structure. The cooler includes an opening in the bottom, and air drawn into the housing through water soaked pads is forced downwardly through the opening in the bottom of the cooler housing. This type of cooler is typically known as a downdraft type evaporative cooler. In this downdraft type of evaporative cooler, the pads are generally located on all four sides of the cooler apparatus. A blower within the housing draws air through the water soaked pads and forces it downwardly through the bottom of the cooler and into an appropriate duct system or simply into the interior of the structure.

Recent developments in the field of evaporative coolers have led to the design of cylindrical cooler housings, which are commonly known as round evaporative coolers. In such coolers, the generally square configuration of the prior art designs is eliminated by a single cylinder, with pads disposed about the entire periphery of the cylinder. The circular or cylindrical housing includes an opening in the bottom through which the air drawn through the water saturated pads is forced out of the cooler and into a duct system or into the interior of a structure.

The second general type of evaporative cooler is a side draft type of cooler. The side draft type of cooler is generally of a rectangular (square) configuration having pads only on three sides. The fourth side is open. The side draft cooler causes air to be drawn into the evaporative cooler housing through the pads on the three sides and the air drawn into the cooler housing is forced out the fourth side. The fourth side is appropriately connected with duct work, or the like.

The side draft evaporative cooler is designed to be secured to the side of a structure, rather than on the top of the structure. The side draft type evaporative cooler may be connected to the side of a building or house through an appropriate hole or aperture in a house or structure or it may be connected to a window on the side of such structure. Regardless of how the side draft cooling apparatus is connected to a structure, the apparatus itself is rather inflexible in that it must be disposed against a mating hole or aperture (window) which receives the flow of air. While it may vary in size, it is still basically a rectangular, box-like structure or housing with one side open. Evaporatively cooled air is delivered through the fourth, open side. If there is a preexisting hole or aperture in the side of a wall, and the hole or aperture fits a particular size of an evaporative cooler, then very little adaptation may have to be made in order to mate the cooler to the aperture or hole. However, this is generally the exception rather than the rule.

While an evaporative cooler may be made in several different sizes, the size of a cooler is generally not the same as any particular window that the cooler will mate with. Accordingly, a window usually needs to be adapted to receive the cooler. Generally this entails an interface of some type between the window and the evaporative cooler.

As is well known and understood, there are many different sizes of windows in contemporary use. The type of window one may find may vary from house (building), structure, etc. to building, perhaps depending on the age of such building. For example, in homes or buildings generally built prior to the late 1940's or early 1950's, double-hung (sash) windows are generally used in most homes. Beginning in the late 1940's and early 1950's, and in use for many years thereafter, casement type windows were popular. These windows were characterized by at least a single fixed panel and a single movable panel, the movable panel being pivoted at one side and pivotable by means of a crank. The casement type windows were generally relatively long or tall, or longer (taller) than their width. The relatively narrow width allowed them to be opened and closed more readily with a pivoting, cranking operation. The relatively high or long dimension, coupled with the relatively narrow width, still provided a substantial opening in terms of square feet for air movement purposes.

The next type of window to be used relatively extensively is the sliding window. In this type of window, a framed window pane simply slides laterally from a closed position to an open position. There is a lock of some type at one side of the window, and, when the lock is released, the window pane slides laterally. An advantage of the sliding window is that it may be made of virtually any size, from a very small, square window to a relatively large, either square or elongated rectangular window.

With sliding windows, due to the relatively large number of sizes employed, a substantial adaptation is required in mating a side draft evaporative cooler to a particular window. However, the removal of a sliding window to allow for a side draft evaporative cooler to be installed is generally less of a problem than the removal of a casement type window. Similarly, the employment of a double-hung or sash-type window is also easier to adapt to an evaporative cooler than is the casement type window which pivots inwardly and outwardly.

If a window is not to be used or adapted to receive a side draft cooler, then a mating hole or aperture must be made through a wall. The hole or aperture may allow the cooler to interface with a duct system or to direct its air flow into the open interior of the structure.

As is well known and understood, the cooling capacity of an evaporative cooler depends on the size of the cooler, with size generally referring to the cubic feet of air which may be moved through the cooler and through its cooling pad area. If a cooler is too large for the room (volume) which it is mated with, the resulting effect on the room, and on the people within the room, will be an extremely humid room, and thus cold, clammy people within the room. On the other hand, if the cooling capacity is not great enough, the result will be a hot room, with very little benefit derived from the lack of cooling capacity of the evaporative cooler.

Evaporative coolers are not considered to be aesthetically pleasing to the eye. It is accordingly desirable to have them out of sight as much as possible. Moreover, for evaporative coolers that are disposed in windows, the windows are generally substantially blocked to the passage of light, and this is not generally desirable.

In contemporary times, with the high cost of energy, the appropriate mating of an evaporative cooler to an area to be cooled is relatively important both from the standpoint of the people within the area to be cooled and also from the cost effectiveness point of view. Accordingly, it is highly desirable that a cooler be mated appropriately with both the area (volume) to be cooled and with the opening through which air will be directed into the structure. For purposes of the present invention, a side draft evaporative cooler for a window is considered for the purpose of cooling a particular room. Accordingly, the adaptation of the room-sized evaporative cooler with a particular window opening and a room is of interest in cost, efficiency, etc. The installation of evaporative coolers is one consideration, and the cooling ability of the cooler with respect to the room (volume) to be cooled is a second consideration.

The apparatus of the present invention is both easy to install and readily adaptable to various sized windows for providing cooling for rooms of various sizes. The apparatus of the present invention is also adaptable to different orientations by rotating a portion of the apparatus. This feature also lends itself to "hiding" a portion of the apparatus from view within the structure and also leaves part of the window open for viewing.

SUMMARY OF THE INVENTION

The invention described and claimed herein comprises an evaporative cooler having a generally rectangular configuration with a module rotatable to any of four positions within a housing so as to appropriately mate with a window opening. The housing is relatively thin so as to reduce the overall weight and size of the unit for simplicity and ease of installation.

Among the objects of the present invention are the following:

To provide new and useful evaporative cooler apparatus;

To provide new and useful evaporative cooling apparatus of modular construction;

To provide new and useful evaporative cooler apparatus having a module capable of orientation in any of a plurality of ways;

To provide new and useful, lightweight evaporative cooler apparatus;

To provide new and useful evaporative cooler apparatus adapted for window installation;

To provide new and useful evaporative cooler apparatus easily installed in a window opening; and To provide new and useful side draft evaporative cooler apparatus.

BRIEF DESCRIPTION OF THE DRAWING

FIG. 1 is a perspective view of the apparatus of the present invention.

FIG. 2 is an exploded rear perspective view of the apparatus of the present invention.

FIGS. 4A, 4B, 4C and 4D are front views of the apparatus of the present invention illustrating the four different installation orientations of the apparatus of the present invention.

DESCRIPTION OF THE PREFERRED EMBODIMENT

Figure 3:
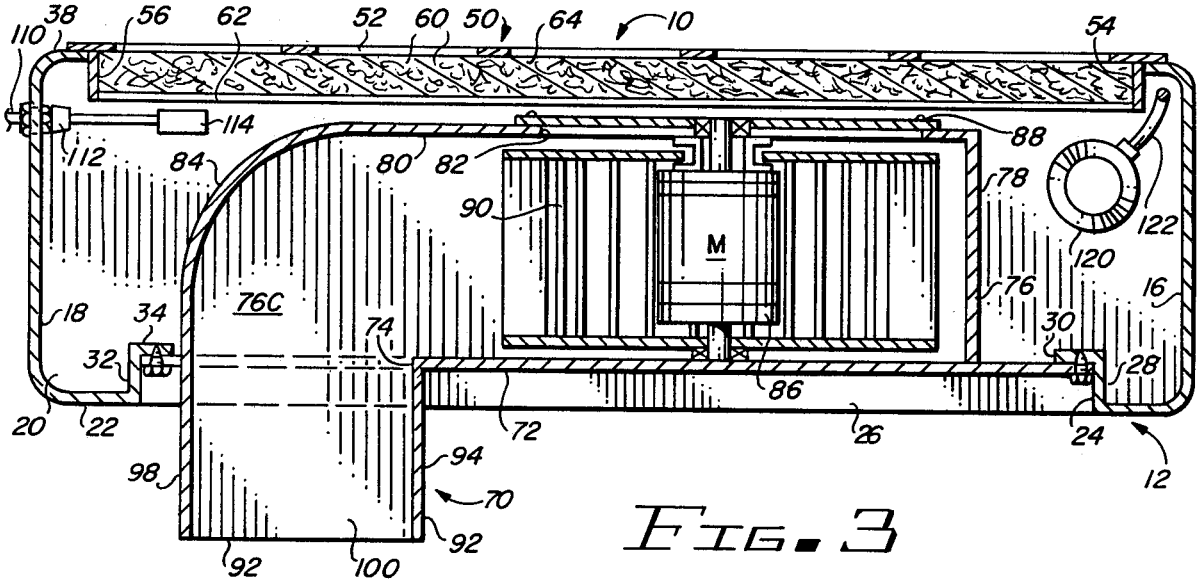
FIG. 3 is a view in partial section of the apparatus of FIG. 1, taken generally along line 3—3 of FIG. 1.

FIG. 1 is a front perspective view of evaporative cooler apparatus 10. FIG. 2 comprises a rear, exploded perspective view of the cooler apparatus 10. FIG. 3 is a view in partial section of the cooler apparatus 10, looking downwardly, and taken generally on line 3—3 of FIG. 1. For the following discussion, reference will primarily be made to FIGS. 1, 2, and 3.

The evaporative cooler apparatus 10 includes a housing 12 which, from the front, is generally of a rectangular or square configuration. The cooler apparatus 10 includes a housing 12 which has a number of panels. The housing 12 includes a top panel 14, a first side panel 16, a second side panel 18, and a bottom panel 20. The top panel 14 and the bottom panel 20 are generally parallel to each other, as are the side panels 16 and 18. The four panels, including the top and bottom panels and the two side panels are each of a rectangular configuration, with the width of each panel representing the width or depth of the cooler apparatus 10.

The housing 12 also includes a front panel 22 which is of a generally rectangular, or square, configuration. The front panel 22 includes a square opening 24. A blower module 70, which will be discussed in detail below, is disposed within the housing 12 and against the opening 24.

The opening 24 includes appropriate structural elements used to secure the module 70 to the housing 12. The structural elements include a bottom support bracket or shelf 26. Extending upwardly from one side of the shelf bracket 26 is a side bracket 28. The side bracket 28 is secured to the front panel 22 at one side of the opening 24. The bracket 28 is substantially perpendicular to the front panel 22, and it extends rearwardly therefrom, into the interior of the housing 12. The side bracket 28 is secured at its bottom part to the shelf 26. The bracket 28 includes a flange 30 which is substantially perpendicular to the bracket 28. The bottom of the flange 30 is also secured to the shelf 26. The flange 30 includes a pair of holes or apertures which receive fastening elements, such as screws, to secure the module 50 to the housing 12.

Parallel to the bracket 28 and its flange 30, and disposed at the opposite side of the opening 24, is a side bracket 32 and a flange 34. The side bracket 32 is generally parallel to the side bracket 28, and its flange 34 is generally aligned with the flange 30. The bottom of the bracket 32 and the flange 34 are also secured to the shelf 26. The flange 34 also includes a pair of holes for receiving appropriate fastening elements for securing the blower module 70 to the housing 12. As is well known and understood, using contemporary sheet metal techniques, the shelf 26, the brackets 28 and 32, and their flanges 30 and 34, respectively, may simply be formed from the same piece of sheet metal out of which the various panels of the housing are formed with the adjoining edges appropriately welded, as desired.

It will be noted that the opening 24 in the front panel 22 is not centrally located with respect to the top panel 14 and the bottom panel 20. The opening 24 is symmetrical with respect to the side panels 16 and 18, but the opening 26 is spaced upwardly from the bottom panel 20 a distance which is substantially greater than the spacing downwardly from the top panel 14. The reason for this may best be understood with reference to FIG. 2, and will be discussed below. The blower module 70 is shown in FIG. 2 spaced apart rearwardly from the housing 12, and thus apart from the opening 24 and the flanges 30 and 32.

The housing 12 also includes a back panel 38. An opening 40 extends through the back panel 38. The opening 40 is defined by four back panel portions, or relatively small panels, including a top panel portion 42, a pair of side panel portions 44, and 46, and a bottom portion 48. It will be noted that while the opening 40 is symmetrical with respect to the sides 44 and 46, it, like the front opening 24, is closer to the top panel 14 than to the bottom panel 20. Thus, the bottom panel portion 28 of the back panel 38 has a greater height than does the top panel portion 42.

The comments with respect to the fabrication of the front panel 22, including its shelf 26, brackets 28 and 32 and their flanges 30 and 34, respectively, are also applicable with respect to the back panel 38 and its subpanels or panel portions 42, 44, 46, and 48. However, the bottom panel 48 is appropriately welded to its side panels 44 and 46 to insure a waterproof condition.

The bottom of the housing 12 defines a sump or reservoir for water. The water is pumped upwardly to the top of the housing 12 and then allowed to flow downwardly through a cooler pad, saturating the pad. The residue of the water, the water not retained in the pad, flows downwardly through the pad and returns to the sump at the bottom of the housing 12. It is thus necessary that the module 70 and also the opening 40 be disposed upwardly from the bottom panel 20 to provide an appropriate sump for water at the bottom of the cooler apparatus 10.

A pad frame 50 is secured to the housing 12 and extends into or is disposed in the opening 40. The pad frame 50 is of a relatively well known and understood configuration. It includes a louvered back panel 52, a pair of side panels 54 and 56 (see also FIG. 3) which are secured to the louvered panel 52, a pair of troughs, including a top trough 58 and a bottom trough 60, and a screened front panel 62 which holds a pad 64 between the side panels, against the louvered back panel 52 between the two troughs 58 and 60. The cooler pad 64 is placed between the side panels and between the troughs of the frame 50 and the screen 62 is used to secure the pad 64 in place. Water, pumped from the bottom of the housing 12, runs into the top trough 58. The trough 58 includes a plurality of spaced apart holes or apertures (not shown) through which the water drains uniformly and flows downwardly through the cooler pad 64 to saturate the trough 60 and returns to the bottom sump or reservoir in the housing 12. The pad frame 50 is not illustrated in detail because it is a well-known and understood element.

A blower 90, part of the module 70, pulls air through the louvered back panel 52 and through the water-saturated pad 64 secured to the pad frame 50, and into the interior of the housing 12.

The blower module 70 includes the air handling elements and the controls for the cooler apparatus 10. The module 70 includes a front plate or panel 72 which is of a generally square configuration, having four sides of equal lengths. The plate or panel 72 mates with the front panel 22 of the housing 12 in any of four orientations, best illustrated in FIGS. 4A, 4B, 4C, and 4D, and discussed below. The panel or plate 72 is secured to the flanges 30 and 34 of the brackets 28 and 32, respectively, by the alignment of four holes or apertures which extend through the plate or panel 72 inwardly from the four corners thereof with the mating holes in the flanges 30 and 34. Appropriate fasteners, such as screws, are used to secure the plate 72 to the flanges 30 and 34.

The panel or plate 72 includes the rectangular opening 74. The rectangular opening 74 is disposed at one side of the plate 72 and generally parallel and disposed relatively close to one of the sides of the plate. The opening 74 is thus asymmetrically located on the plate. As is obvious from FIG. 1 and from FIGS. 4A–4D, the rectangular opening 74 is relatively long as compared with its width. An air exit nozzle 92 extends forwardly from the opening 74. The nozzle 92 will be discussed in detail below.

Secured to and supported by the panel or plate 72 is a blower housing 76. The blower housing 76 includes an end plate 78. The end plate 78 has several portions, including a relatively flat top 78*a* (see FIG. 2), and a curved side and bottom 78*b* which conforms to the configuration of the blower 90 disposed within and secured to the blower housing 76 and to the panel or plate 72, as best shown in FIG. 3. The end plate 78 also includes a relatively flat portion 76*c* (see FIG. 3) substantially parallel to its top flat portion 76*a* and which comprises a portion of the air exit nozzle 92. The rear or back portion of the blower housing 76 includes a back panel 80 and a curved plate 84. The back panel 80 has an opening 82 extending therethrough. Air is drawn through the opening 82 by the blower 90. The curved end plate 84 is a continuation of the back plate 80 and it also defines a portion of the air exit nozzle 92, as will be discussed below.

The interior of the blower housing 76, and details of the module 70, may be viewed best with reference to FIG. 3. For the following discussion, reference will be made primarily to FIGS. 2 and 3.

Within the blower housing 76 is an electric motor 86. The motor is secured to the front panel 72 of the module 70 and, through a three-arm spider assembly 88, to the back panel 80. The three arms of the spider assembly 88 are secured to the back panel 80 about the opening 82.

The blower 90 is secured to the rotating shaft of the motor 86. The motor 86 is disposed within the blower 90, thus increasing the efficiency of the apparatus by decreasing the space involved and by decreasing the separate elements needed. For example, in a conventional evaporative cooler, it is common to have a squirrel cage type blower, which blower 90 is, spaced apart from a motor and connected to the motor by a flexible belt through a pulley system. With the apparatus of the present invention, the motor 86 is disposed within the blower 90, and the blower is secured directly to the rotating armature shaft of the motor.

The air exit nozzle 92 extends forwardly, with respect to the housing 12, from one side thereof. The air exit nozzle 92 includes four panels, including a pair of elongated side panels 94 and 98, which are substantially parallel to each other, and a pair of relatively short panels 96 and 100, which are also generally parallel to each other. The four panels 94, 96, 98, and 100 define a rectangular nozzle through which air blows from the blower housing 76 into the room in which the evaporative cooler apparatus 10 is disposed.

As indicated above, and as will be best understood from FIGS. 2 and 3, the top panel 96 of the air exit nozzle 92 is a continuation of part of the flat upper end plate portion 78*a* of the blower housing 76. The plate 96 extends forwardly from the end plate 78. Similarly, the side panel 98 of the exit nozzle 92 is a continuation of the end plate 84 of the blower housing 76. The panel 98 simply is an extension of the end plate 84 forwardly of the plate 72. Finally, the bottom plate or panel 100 is a continuation, at the bottom of the blower housing 76, of the panel portion 78*c*, substantially parallel to part of the top portion 78*a* of the panel 78 and to the top panel 96 of the air exit nozzle 92.

The air nozzle 92 is asymmetrically disposed or located on the plate 72 since it is disposed adjacent to one side thereof and thus remote from the opposite and parallel side. The air nozzle 92 is also disposed asymmetrically with respect to the housing 12, as will be discussed below in conjunction with FIGS. 4A–4D.

For convenience in appropriately directing the air flowing from the exit nozzle 92, the front of the exit nozzle 92 may be covered by an appropriate louvered panel, not shown. The louvers of such panel may be adjustable to direct the air flow as desired, as is well known and understood. Thus, the movable louvers may include louvers for directing the air flow in any of one or more directions, as desired.

For controlling the water flow in the evaporative cooler apparatus 10, a water line 110 is appropriately secured to the lower portion of the side panel 18 of the housing 12. Within the housing 12, and connected to the water line 110, is a control valve 112. The flow of water through the valve 112 is controlled by a float assembly 114. The valve 112, its float 114, and the cooperation with the water line 110, are all well known and understood in the art. When the water within the bottom (sump or reservoir) of the housing 12 reaches a predetermined level, as determined by the setting of the float 114, the valve 112 turns off the water flow through the water line 110. At such time as the water level decreases below a predetermined amount, the lowering of the float 114 opens the valve 112 to allow the water to be replenished. The water level within the bottom sump portion of the housing 112 is thus kept at a relatively constant, predetermined height to provide a relatively constant quantity of water. For convenience in installing the cooler apparatus 10, and in connecting a water supply to the housing 12, knock out plugs may be located on the side panels 16 and 18. Thus, the water line 110, and the valve 112 and float 114, may be connected to either side 16 or side 18 of the housing 12.

An overflow pipe or standpipe 130 extends upwardly from the bottom panel 20 of the housing 12. The standpipe 130 is preferably centered on the bottom panel 20.

For pumping the water from the sump at the bottom of the housing 12 to the top trough 58 of the pad frame 50, an evaporative cooler pump 120 is used. The pump 120, like the valve assembly 112, is old and well known and understood in the art. The pump 120 pumps the water from the bottom of the housing 12 upwardly through a conduit 122 to the top trough 58.

As stated above, the trough 58 includes a plurality of slots or holes which allow the water pumped upwardly through the conduit 122 to flow downwardly through the pad 64 secured to the pad frame 50. The water flow through the trough 58 is fairly even and regular to allow the cooler pads 64 to be saturated in a relatively uniform manner. Air flowing through the water saturated cooler pad gives off heat of vaporization to the water in the pad frame, thus lowering the temperature of the air and increasing the relative humidity of the air by evaporating the water. The air is pulled into the housing 12 through the cooler pad 64 in the frame 50 by the blower 90. The blower 90 in turn is secured to the motor 86. Air pulled into the housing 12, and through the opening 82 in the blower housing 76, flows out of the blower housing 76 through the air exit nozzle 92.

Both the blower motor 86 and the electric motor in the pump 120 needs to be connected to a source of electrical energy. For convenience, all electrical controls are secured to the module 70. An electrical cord (not shown) is provided that is long enough to reach the pump 120, regardless of the module orientation. An electric cord extends outwardly through the air exit nozzle, or through a grill disposed thereon.

In FIGS. 4A, 4B, 4C, and 4D, the module 70 is oriented with respect to the front panel 22 of the housing 12 in four different arrangements. The ability to orient the module in any of the four positions provides flexibility in the installation of the evaporative cooling apparatus 10 that is not provided heretofore with the coolers of the prior art.

Figure 5:
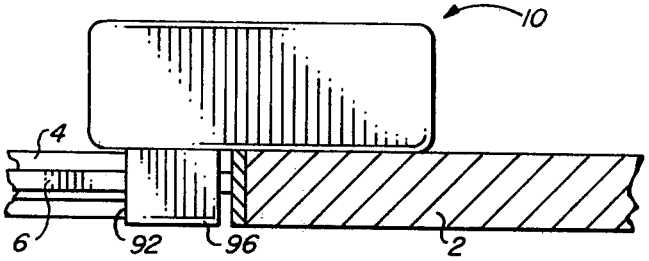
FIG. 5 is a top view of the apparatus of the present invention in its use environment.

Since the housing 12 is relatively thin, as may be understood from FIGS. 1, 2, 3, and 5, the cooler apparatus 10 is relatively easily secured to a wall or to a window, or to a wall adjacent to a window. As shown in FIGS. 4A, 4C, and 5, the air exit nozzle 92 of the module 70 may be oriented vertically, on either side of the cooler. In the alternative, as shown in FIGS. 4B and 4D, the air exit nozzle 92 may be oriented horizontally, either at the top of the apparatus or at the lower portion of the apparatus.

The module 70 may be rotated to any of the four orientations shown in FIGS. 4A through 4D. This permits the cooler apparatus 10 to be located most conveniently with respect to any particular window and adjacent wall. Hopefully, the cooler apparatus 10 may be mounted on a wall adjacent to a window, with only a portion of the cooler apparatus, including the air nozzle 92, disposed in front of the window. This minimizes the amount of window area blocked by the cooler 10 and maximizes the window area for viewing. In turn, the amount of the cooler 10 which is hidden from view against a wall is maximized.

With the air exit nozzle 92 of a generally rectangular configuration, and disposed asymmetrically at one side on the plate 72, the evaporatively cooled air is directed outwardly from the housing 12 from different locations corresponding to each of the orientations of the plate 72 and module 70 on the front panel 22 of the housing 12. This allows great flexibility in the location of the housing 12 with respect to any window or opening on a building (home), and allows great flexibility in the precise location or placement of the air nozzle 92.

FIG. 5, which is a top view of the apparatus 10, illustrates the use environment of the evaporative cooler apparatus 10. A window 4 extends through a wall 2. The window 4 includes a sliding portion 6 which is opened a slight amount to allow the air exit nozzle 96 to extend through the window and into a room. The cooler apparatus 10 is disposed against the outer side of the wall 2, adjacent to the window 4, but occupies only a relatively small portion of the window, itself, thus providing a maximum amount of viewing area for the window. At the same time, the air exit nozzle 92 is easily sealed to the wall 2 on one side and to the sliding window 6 on the opposite side. The bottom panel 100 of the exit nozzle 92 may also be relatively easily sealed, preferably to the bottom of the window. Similarly, the area above the upper panel 96 of the nozzle 92 may also be relatively easily sealed. Preferably, but not necessarily, the nozzle 92 extends into the room, with the front panel 22 disposed against the outside wall.

Since the evaporative cooler apparatus 10 is relatively compact in design, it is also relatively light in weight, thus enhancing the ease of installation of the apparatus and diminishing the need for extensive support racks, etc.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This sepcification and the appended claims have been prepared in accordance with the applicable patent laws and the rules promulgated under the authority thereof.

What is claimed is:

1. Evaporative cooler apparatus, comprising, in combination:

relatively thin housing means, including
- a front panel,
- a back panel,
- a pad means disposed in the back panel,
- a sump for holding a quantity of water, and
- water means for providing a flow of water through the pad means; and blower module means adapted to be disposed in any one of a plurality of orientations, and including
- a plate securable to the front panel in a plurality of orientations,
- a blower secured to and supported by the plate for causing a flow of air through the pad means, and
- an air nozzle asymmetrically secured to the front plate for receiving the flow of air from the blower and for directing the flow of air out of the housing means from different locations with respect to the housing means as the orientation of the plate is changed on the front panel.

2. The apparatus of claim 1 in which the plate of the blower module means is of a generally square configuration, having four sides of substantially equal length.

3. The apparatus of claim 2 in which the air nozzle is disposed adjacent to one side of the plate and remote from the opposite side to define the asymmetrical disposition of the air nozzle.

4. The apparatus of claim 1 in which the blower module means further includes a blower housing secured to the plate, and the blower is disposed within the blower housing.

5. The apparatus of claim 4 in which the air nozzle communicates with the blower housing and receives the flow of air therefrom.

6. The apparatus of claim 5 in which the blower module means further includes a blower motor disposed within the blower housing and connected to the blower for causing the flow of air through the pad means, into the blower housing, and out the air nozzle.

* * * * *